US007021856B2

(12) United States Patent
Assler et al.

(10) Patent No.: US 7,021,856 B2
(45) Date of Patent: Apr. 4, 2006

(54) SPLICING FOR INTERCONNECTED THIN-WALLED METAL STRUCTURES

(75) Inventors: Herwig Assler, Jork (DE); Hans-Juergen Schmidt, Buxtehude (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 10/648,185

(22) Filed: Aug. 25, 2003

(65) Prior Publication Data

US 2004/0052581 A1 Mar. 18, 2004

(30) Foreign Application Priority Data

Aug. 23, 2002 (DE) ..... 102 38 820

(51) Int. Cl.
*F16B 5/04* (2006.01)

(52) U.S. Cl. ..... 403/408.1; 29/524.1; 29/525.06; 29/525.02; 244/131; 244/132

(58) Field of Classification Search ..... 403/408.1, 403/405, 282, 274; 29/524.1, 525.06, 525.05, 29/525.02, 525.03, 402.12, 402.14, 897.2, 29/434, 437; 428/57; 52/578, 582.1, 588.1; 296/181; 411/501; 244/131, 132
See application file for complete search history.

(56) References Cited

U.S. PATENT DOCUMENTS

| | | | | |
|---|---|---|---|---|
| 2,746,579 | A * | 5/1956 | Gondek | 403/408.1 |
| 4,394,096 | A * | 7/1983 | Stevens | 403/408.1 |
| 5,297,760 | A * | 3/1994 | Hart-Smith | 244/132 |
| 6,775,895 | B1 * | 8/2004 | Koffi et al. | 29/407.08 |

* cited by examiner

*Primary Examiner*—Jack W. Lavinder

(74) *Attorney, Agent, or Firm*—W. F. Fasse; W. G. Fasse

(57) ABSTRACT

A rivet splice that holds an upper and a lower sheet metal end portion together includes at least one row (6) of rivets that is subject to dynamic loads and a further row (7) of rivets that holds the sheet metal end portions together so that a limited sliding motion between the sheet metal end portions is possible. The further row (7) of rivets is positioned between an end edge (4A) of an upper sheet metal end portion and the at least one row (6) of rivets. The limited sliding motion provides a load relief of the at least one row of rivets thereby reducing the starting of cracks at the walls of the rivet holes and impeding the spreading of cracks.

13 Claims, 2 Drawing Sheets

SPLICING FOR INTERCONNECTED THIN-WALLED METAL STRUCTURES

PRIORITY CLAIM

This application is based on and claims the priority under 35 U.S.C. § 119 of German Patent Application 102 38 820.2, filed on Aug. 23, 2002, the entire disclosure of which is incorporated herein by reference.

FIELD OF THE INVENTION

The invention relates to a device, also referred to as splicing, for connecting thin-walled sheet metal end portions to each other in an overlapping contact surface area. At least one row of rivets subject to cyclical or dynamic loads is arranged in the overlapping area for splicing the two sheet metal end portions to one another.

BACKGROUND INFORMATION

At the present time rivet connections described above are the predominantly used splicing connections in aircraft construction.

In such conventional splicing connections an interlocking is achieved between the parts to be interconnected by a mechanical interlocking of geometric shapes to thereby provide an interlocking splice connection. In such connections it is necessary that the resistance of the inwardly facing walls of the rivet holes in the individual sheet metal portions and the shearing resistance of the rivets must be larger than the loads externally applied to the splice. Conventionally one or several rows of rivets are used in such splices of mutually overlapping sheet metal end portions, whereby full volume rivets, tight fit rivets, threaded rivets, or blind rivets are used. Typical examples for the connection of thin-walled structures are longitudinal and cross seams, as well as seams surrounding a repaired skin section. A multitude of rivet connections in an aircraft, particularly an aircraft body skin, is of basic importance for the flight characteristics of an aircraft. The rivets are individually dimensioned for the particular riveted splice taking into account the type of rivet, the size of the rivets, the spacing between the rivets and so forth, particularly paying attention to the local static and dynamic loads. In this connection it is an essential requirement that the splice has a high useful life and is substantially free of the need for inspections or requires only few inspections.

During the operation of an aircraft large areas or sections of the aircraft structure are subject to cyclical or dynamic tension loads. As a result, the components made of metallic materials are exposed to the potential danger of fatigue due to crack formations followed by crack progression or crack creeping. Individual cracks and particularly widespread fatigue damage caused by cracks can substantially reduce the strength characteristics of these metal components. These fatigue characteristics must be taken into account when inspection intervals are scheduled. In aircraft construction the thin-walled structures which have been optimized with regard to weight reduction are frequently subject to a high secondary bending load component, whereby a low crack resistance duration occurs which simultaneously requires a high inspection effort and expense. A secondary bending has been observed to occur when the load axis and the neutral phase are not identical in a structural component. For example, in the case of a splice interconnecting two overlapping sheet metal end portions the load axis and the neutral phase are staggered relative to each other.

OBJECTS OF THE INVENTION

In view of the foregoing it is the aim of the invention to achieve the following objects singly or in combination:

- to increase the fatigue strength in riveted splice connections having a high secondary bending component;
- to prevent, or at least reduce, the formation of cracks and their spreading;
- to provide such splice connections with an improved crack progression characteristic and to reduce the stress on conventional rows of rivets; and
- to place an additional specially constructed row of rivets between an end edge of an end portion, such as a sheet metal end portion and a conventional row of rivets.

SUMMARY OF THE INVENTION

A splice between thin-walled structural components formed by at least one dynamically or cyclically loaded row of rivets is improved according to the invention by a further row of rivets positioned between an end edge of an end portion and the first mentioned row of rivets. The additional row of rivets is so constructed or provided with features that hold the two end portions together while simultaneously permitting a relative motion in the contact surface area between the two end portions, which are preferably sheet metal end portions.

Such an additional row of rivets constructed according to the invention has the advantage that particularly the conventional rivet row next to the additional rivet row is relieved at least partially of its high dynamic loads while the additional row of rivets is primarily exposed to a secondary bending load. The additional row of rivets extends preferably in parallel to the at least one conventional row of rivets. The reduction of the maximum tension load in the conventional rivet row or rows as achieved by the invention leads to an increased useful life with regard to crack formations. More specifically, the beginning of crack formations is reduced. Similarly, crack spreading following the formation of any crack is also reduced. Another advantage of these features according to the invention is seen in that the time intervals between inspections may be longer, thereby reducing the effort and expense for the inspection of such splice connections. This advantage is particularly important for riveted splices in aircraft because unscheduled dead times on the ground have been eliminated by eliminating additional inspections that were required heretofore.

Another advantage of the invention is seen in that additional methods can be employed for a targeted reduction of the locally effective maximum tension load. One such method involves work hardening. More specifically, a rivet hole is plastically deformed in the radial direction by widening the rivet hole for generating in the wall of the rivet hole tangentially effective residual compression stress which counteracts the effective tension load on the rivet hole. It is known from experiment that this work hardening is relatively ineffective in a structure subject to a large secondary bending load. However, it has been found that the work hardening of the rivet holes in combination with the invention can develop its full effectiveness in the conventional rivet row or rows because the additional rivet row according to the invention has deflected secondary bending loads from the conventional rivet rows by taking up such secondary bending loads itself. More specifically, secondary bending loads are now primarily effective only in the additional rivet row which neutralizes such bending loads by the limited relative movement between the sheet metal end portions.

A still further advantage of the invention is seen in that the flight characteristics of an aircraft have been improved by the teaching of the invention.

BRIEF DESCRIPTION OF THE DRAWINGS

In order that the invention may be clearly understood, it will now be described in detail in connection with example embodiments thereof, with reference to the accompanying drawings, wherein.

DETAILED DESCRIPTION OF PREFERRED EXAMPLE EMBODIMENTS AND OF THE BEST MODE OF THE INVENTION

Figure 1:
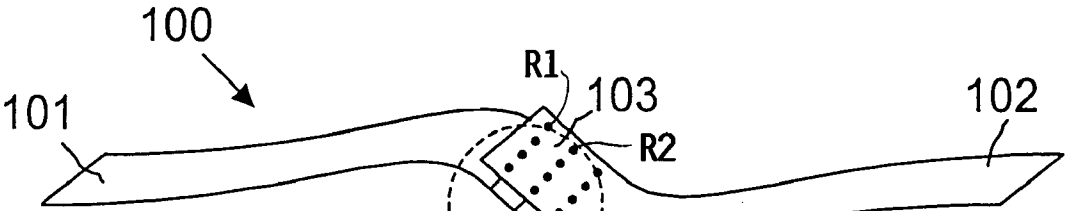
FIG. 1 is a perspective view of a conventional splice of an aircraft structural component in its deformed state.
Figure 2:
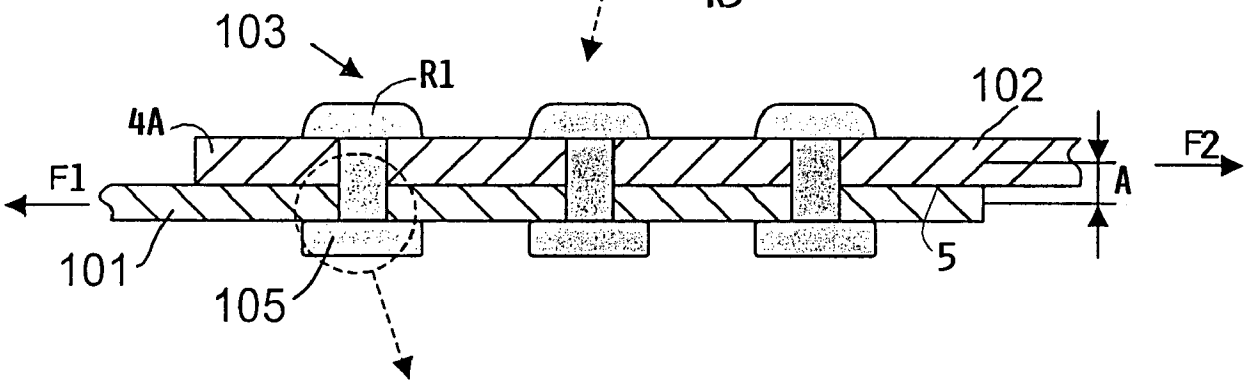
FIG. 2 is a sectional view of a conventional splice between two sheet metal end portions showing three rows of rivets as in FIG. 1.
Figure 3:
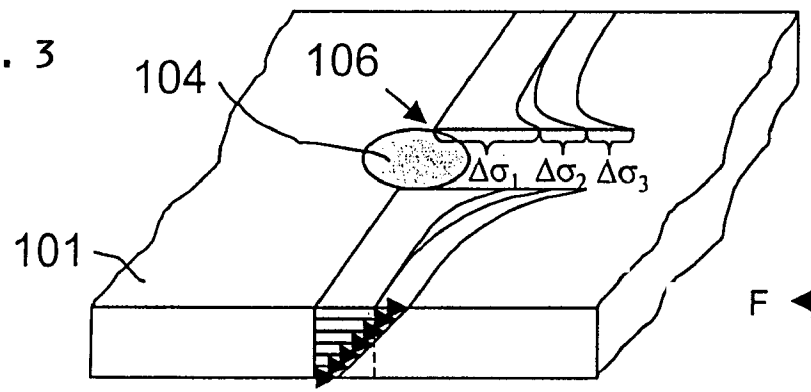
FIG. 3 is a schematic illustration on an enlarged scale of the lower sheet metal end portion illustrating the stresses that occur in the wall of a rivet hole.
Figure 3A:
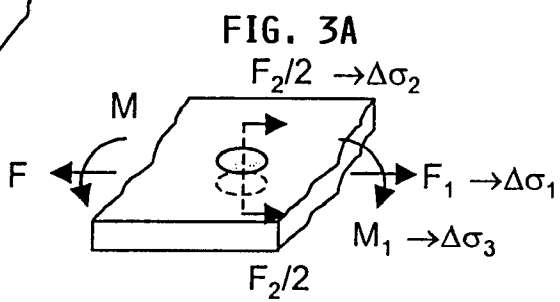
FIG. 3A is a view similar to FIG. 3 showing force components effective in a rivet hole.

FIGS. 1 to 3 illustrate a conventional rivet splice connection between skin sections 101 and 102 of an aircraft structure 100. Three rows R1, R2 and R3 of rivets form the splice 103. During operation of an aircraft the so constructed aircraft structure 100 is exposed to a cyclical or dynamic tensional load, which causes locally a bending load which flexes the splice as shown within the dashed circle in an exaggerated manner in connection with sheet metal materials that are conventionally used for the construction, for example of an aircraft body skin. There is the potential danger of material fatigue, particularly in the splice accompanied by crack formations following by crack spreading or crack progression. Individual cracks, and particularly the interaction of a plurality of cracks causing a widespread fatigue damage may substantially reduce the strength characteristics of the aircraft structure.

Referring to FIG. 2, the bending load effective in the splice is referred to as a secondary bending which is caused by the fact that the two tension loads F1 and F2 are not effective in the plane of the interface also referred to as contact surface area 5 between the overlapping end portions of the two skin sections or end portions 101 and 102. Rather, the forces F1 and F2 are each effective centrally in the respective end portion, whereby a lever arm "A" is formed between the two forces F1 and F2 as shown in FIG. 2 to generate a bending moment. The location of the maximal secondary bending is customarily in the outer row R1 of rivets 105. Particularly in aircraft construction a high secondary bending proportion can be observed in the thin-walled structures in the first row R1 of rivets 105 next to an end edge 4A.

The fatigue strength that represents the duration between service initiation and the beginning of cracks at the edge of a rivet hole is influenced substantially by the locally occurring maximal secondary bending or rather tension. FIG. 3 illustrates the tension distribution at a rivet hole 104 in the sheet metal end section 101 in connection with an example of a single shear, triple row rivet splice connection 103. The riveting performed for the formation of the splice connection between the sheet metal end portions 101 and 102 leads to a very inhomogeneous tension distribution around the rivet hole 104. In a simplifying approach it is possible to interpret the locally occurring maximal tension $\sigma_{max}$ as a superposition of three individual load situations. Thus, $$\sigma_{max}=\Delta\sigma 1+\sigma 2+\Delta\sigma 3$$

wherein the first load situation involves a plane plate with an empty rivet hole exposed to a longitudinal load F1 (F1→$\Delta\sigma 1$), the second load situation involves a plane plate with a filled hole and a pin load (F2→$\Delta\sigma 2$), the third load situation involves a plane plate with an empty hole exposed to bending ($M_1$→$\Delta\sigma 3$).

The location of the maximal secondary bending in a multi-row longitudinal splice 103 is normally the outer rivet row 105 which is thus referred to as a fatigue critical rivet row. The initiation of a crack 106 takes place first at the edge of a rivet hole 104 in this row.

Figure 4:
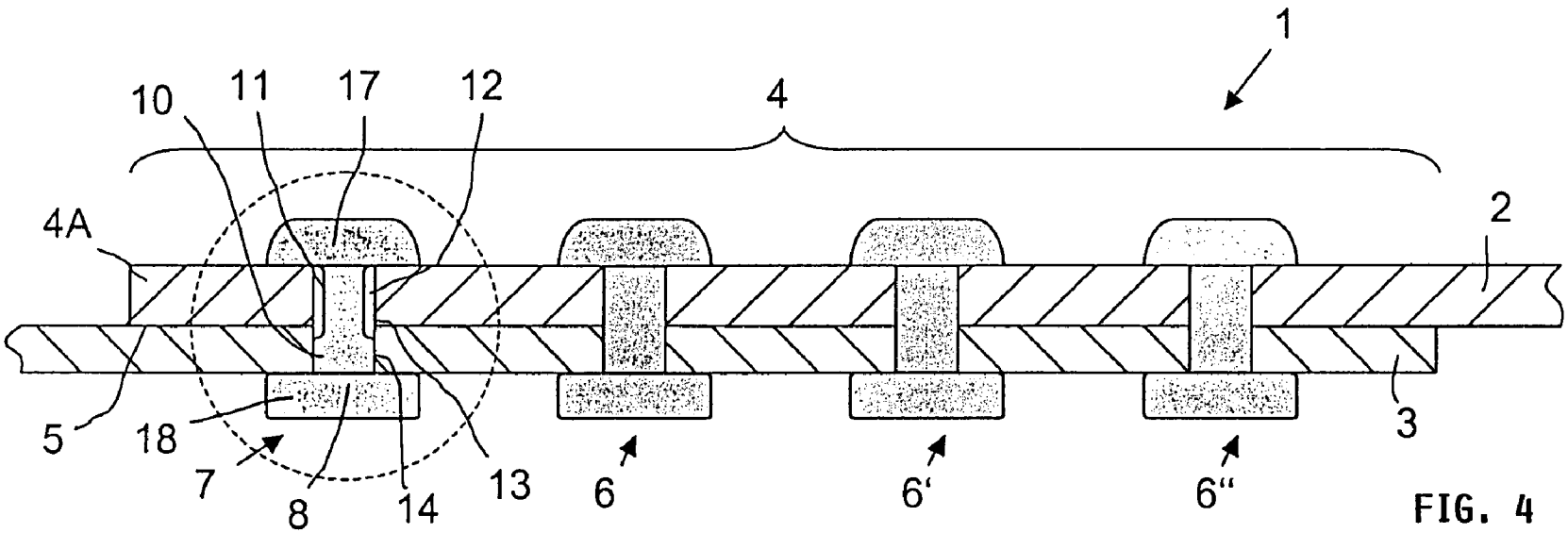
FIG. 4 shows a schematic sectional view through a splice according to the invention.

FIG. 4 illustrates a rivet splice connection according to the invention. A sheet metal end portion 2 with an end edge 4A overlaps a sheet metal end portion 3 along an overlapping area 4 to provide a contact surface area 5 along the overlap 4 of a splice 1. Displaced from the end edge 4A there are provided, for example three conventional rows 6, 6' and 6" of rivets. As explained with reference to FIGS. 1 to 3, the fatigue critical rivet row is the row 6 positioned closest to the end edge 4A in the overlapping area 5 Between the sheet metal end portions 2 and 3.

According to the invention the fatigue critical rivet row 6 is partially relieved of the above discussed loads by a rivet row 7 positioned according to the invention between the end edge 4A and the row 6, whereby the fatigue strength of the splice connection having a high secondary bending proportion is increased and the crack propagation is correspondingly reduced, that is improved. For this purpose the maximal tension in the critical initially outer rivet row 6 is reduced by reducing the secondary bending moment proportion $\Delta\sigma 3$ to a minimum. This is achieved by the additional rivet row 7 which is primarily exposed only to the secondary bending proportion $\Delta\sigma 3$. The initially critical outer rivet row 6 has now become the second rivet row which is exposed to a significantly reduced bending load.

By positioning the additional rivet row 7 preferably in parallel to and between the end edge 4A and the row 6, the additional rivet row 7 reduces the load to which the conventional rivet row 6 is exposed in a conventional rivet splice 103. The bending loads are also reduced in the rivet row 6' and 6" and this reduction in all three conventional rivet row 6, 6' and 6" leads to a prolonged duration between putting the structural component into service and the occurrence of a crack. Simultaneously the crack progression is reduced.

According to the invention the additional rivet row 7, features rivets 8 that provide a clamping force in the direction of the longitudinal axis 9 of a rivet shaft 10 to provide a positive interlocking to keep the sheet metal end portions 2 and 3 in contact with each other. Thus, a vertical displacement of the sheets 2 and 3 is prevented by this positive interlocking. However according to the invention, features are provided that permit a horizontal relative displacement or motion between the two portions 2 and 3. This horizontal relative motion is impeded only by friction, but not by a positive interlocking.

FIG. 4 shows a first embodiment of a rivet 8 having a rivet head 17, a rivet shaft 10, and a rivet closure 18. The shaft 10 is provided with a larger diameter portion and with a smaller diameter portion 11 to form a gap 12 between the reduced diameter rivet shaft portion and the facing wall of the respective rivet hole. The clamping force in the axial direction of the rivet shaft is only large enough so that the first sheet metal end portion 2 can move relative to the second sheet metal end portion 3 under the influence of the respective friction force. The gap 12 between the wall of the rivet hole 13 and the reduced diameter shaft portion 11 permits this relative motion. Simultaneously, the larger diameter portion of the shaft 10 is fully fitted and snugly engaged with the rivet hole 14 in the second sheet metal end portion 3.

Figure 5:
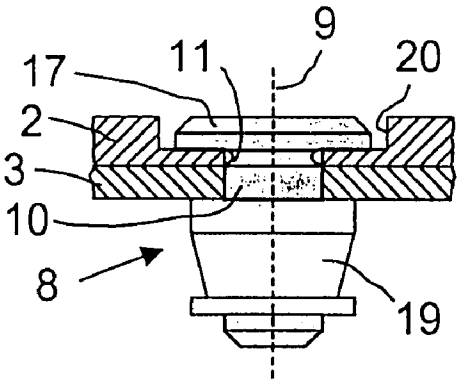
FIG. 5 shows one embodiment of a rivet connection according to the invention with a necked-down rivet shaft and a threaded collar for tightening the rivet.
Figure 6:
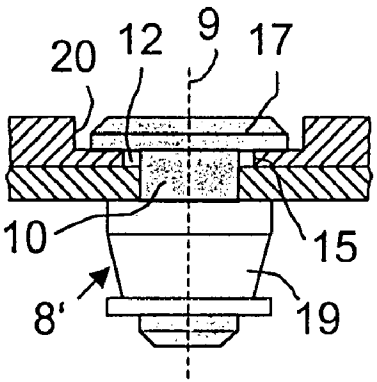
FIG. 6 is a view similar to that of FIG. 5, however showing an enlarged diameter rivet hole in the upper sheet metal end portion.
Figure 7:
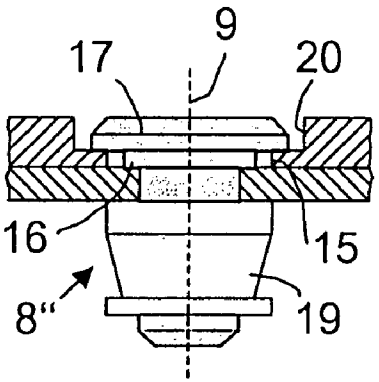
FIG. 7 is a view similar to that of FIG. 6 with a rivet shaft provided with a shoulder and an enlarged rivet hole in the upper sheet metal end portion.

FIGS. 5, 6 and 7 show structural embodiments of rivet constructions 8, 8' and 8" according to the invention. In each embodiment so-called "Hi-Lok" (Tradename) fitted rivets are used with a threaded shaft and an internally threaded closure ring or so-called high lock collar 19 (Tradename) is used. A groove or recess 20 in the upper sheet metal portion 2 permits the top surface of the rivet head 17 to be flush with the top surface of the upper sheet metal end portion 2. It is preferred that a press-fit or interference fit is provided between the rivet hole 14 in the lower sheet metal end portion 2 and the respective shaft portion of the rivet shaft 10.

In the embodiment of FIG. 5 the rivet shaft has a reduced diameter necked-down portion 11 which performs the same function as the reduced diameter portion 11 in FIG. 4. The length of the necked-down shaft portion in the direction of the central longitudinal rivet axis 9 is selected in accordance with the thickness of the sheet metal in the recess 20 on which the rivet head 17 is bearing. It is preferred, that the axial length of the necked-down portion is slightly larger than the thickness of the just mentioned sheet metal portion on which the rivet head 17 is bearing. This feature makes sure that the horizontal motion of the sheet metal portions 2 and 3 relative to each other is impeded primarily by friction rather than by the axially extending clamping force. The clamping force and the friction force can be optimized by a defined torque moment applied to the rivet closure ring or collar 19.

In the embodiment of the rivet 8' of FIG. 6 the rivet shaft 10 has a uniform diameter throughout its length and the relative motion is made possible by a rivet hole 15 in the upper sheet metal portion 2 that has a diameter sufficient to provide for the gap 12 between the inwardly facing wall of the rivet hole 15 and the shaft 10. Here again the axial clamping force and the horizontal friction force can be adjusted by a defined torque moment applied to the ring collar 19 that has an internal threading cooperating with an external threading on the rivet shaft portion protruding out of the lower sheet metal end portion 3.

FIG. 7 shows an embodiment similar to that of FIG. 6, however in addition to the enlarged diameter rivet hole 15 in the upper sheet metal end portion 2, the rivet shaft has a shoulder 16 with an enlarged diameter relative to the rivet shaft portion passing through the respective hole in the lower sheet metal end portion 3. Here again the gap 12 around the shoulder 16 permits a relative horizontal motion of the sheet metal portions 2 and 3. The shoulder 16 provides a positive interlocking in the vertical direction parallel to the central axis 9 of the rivet 8". The desired clamping force and friction force can again be adjusted by the thread collar closure collar 19.

In all embodiments the recess or groove 20 is so-dimensioned, that a sufficient play is permitted between the edges of the recess 20 and the rivet head 17 to permit the desired limited relative motion between the end portions 2 and 3.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A splice for connecting thin-walled components to each other, said splice comprising a first end portion of a structural component, a second end portion of a further structural component, an overlapping contact surface area between said first and second end portions, at least one fatigue critical row (6) of rivets subject to dynamic loads and passing through said first and second end portions and through said overlapping contact surface area, a further row (7) of rivets extending between an end portion edge (4A) and said at least one fatigue critical row of rivets, said further row (7) of rivets comprising rivets holding said first and second end portions together in a direction perpendicularly to said overlapping contact surface area, said further row (7) of rivets comprising rivet shafts (10, 16), and a gap providing play (at 11, 12, 15) between each of said rivet shafts and any one of said first and second end portions for permitting a relative motion of said first and second end portions in a direction parallel to said overlapping contact surface area for reducing crack formation and crack propagation and for relieving stress from said fatigue critical row (6) of rivets.

2. The splice of claim 1, wherein said further row of rivets comprises rivets each respectively including a rivet head, a respective one of said rivet shafts, and a rivet closure for providing a positive interlocking force in a direction parallel to a central axis (9) of said rivet shaft and for further providing a slidable fit in said direction parallel to said overlapping contact surface area, said positive interlocking force providing friction in said overlapping contact surface area.

3. The splice of claim 2, wherein said rivet shaft comprises a first shaft section with a first shaft diameter fitting snugly into a first rivet hole in one of said first and second end portions, and a second shaft section having a second diameter smaller than said first shaft diameter, said second smaller shaft diameter providing said gap (12) between said second shaft section and a wall of a second rivet hole in the other end portion of said first and second end portions for permitting said relative motion.

4. The splice of claim 2, wherein said rivet shaft comprises a uniform shaft diameter between said rivet head and said rivet closure, said first end portion having a first rivet hole with a hole diameter providing a snug fit between a wall of said first rivet hole and said rivet shaft, said second end portion having a second rivet hole with a hole diameter larger than said uniform shaft diameter thereby providing said gap (12) between said rivet shaft and a wall of said second rivet hole for permitting said relative motion.

5. The splice of claim 3, comprising a press-fit or interference fit between said first shaft diameter and a wall of said first rivet hole.

6. The splice of claim 4, comprising a press-fit or interference fit between said rivet shaft and a wall of said first rivet hole.

7. The splice of claim 2, wherein said rivet shaft comprises a shaft shoulder (16) for clamping one of said first and second sheet metal end portions.

8. The splice of claim 2, wherein said rivet shaft has such an axial shaft length that a defined clamping force providing friction in said splice is applied to said first and second sheet metal end portions when said rivet is set.

9. The splice of claim 2, wherein said rivet shaft has a threaded shaft end, and wherein said rivet closure comprises a closure ring or collar with an internal threading cooperating with said threaded shaft end for applying an adjustable clamping force to said first and second sheet metal end portions.

10. The splice of claim 2, wherein each of said rivets in said further row of rivets comprises a locking collar.

11. The splice of claim 2, wherein said first and second end portions comprise an upper sheet metal end portion and a lower sheet metal end portion, said upper sheet metal end portion comprising a recess (20) for receiving said rivet head.

12. The splice of claim 1, wherein said further row (7) of rivets extends directly next to said end portion edge (4A) and in parallel to said at least one fatigue critical row (6) of rivets that is subject to dynamic loads, whereby said end portion edge (4A), said fatigue critical row (6) and said further row (7) extend in parallel to one another.

13. The splice of claim 1, wherein said gap providing play is positioned between said rivet shaft and that end portion of said first and second end portions which forms an upper end portion.

* * * * *